US008684020B1

(12) United States Patent
Shires

(10) Patent No.: US 8,684,020 B1
(45) Date of Patent: Apr. 1, 2014

(54) MODIFIED A-FRAME TENT SHELTER

(76) Inventor: Henry C. Shires, Nevada City, CA (US)

( * ) Notice: Subject to any disclaimer, the term of this patent is extended or adjusted under 35 U.S.C. 154(b) by 0 days.

(21) Appl. No.: 13/562,745

(22) Filed: Jul. 31, 2012

Related U.S. Application Data

(60) Provisional application No. 61/513,827, filed on Aug. 1, 2011.

(51) Int. Cl.
*E04H 15/00* (2006.01)

(52) U.S. Cl.
USPC ..... 135/87; 135/97; 135/123

(58) Field of Classification Search
USPC ..... 135/87, 97, 99, 115, 116, 117, 123
See application file for complete search history.

(56) References Cited

U.S. PATENT DOCUMENTS 2,263,867 A * 11/1941 Barnard ..... 135/90
3,043,320 A * 7/1962 Moss ..... 135/93
3,468,321 A * 9/1969 Thompson ..... 135/95
3,741,224 A * 6/1973 Clelland ..... 135/87
3,943,952 A * 3/1976 Marquart et al. ..... 135/93
5,477,876 A * 12/1995 Moss ..... 135/97
7,841,356 B2 11/2010 Shires
2008/0302403 A1* 12/2008 Stewart ..... 135/114

OTHER PUBLICATIONS

Trailspace, Nemo Meta 2P, Three-Season Tent reviews, Aug. 1, 2010, 3 pages, www.trailspace.com, U.S.
Black Diamond, Betamid, "Gear" section of manufacturer website, Mar. 12, 2006, 1 page (supplemented by 2pages of add'tl photos, specs), www.bdel.com, U.S.

* cited by examiner

*Primary Examiner* — Noah Chandler Hawk
(74) *Attorney, Agent, or Firm* — Northern Michigan Patent Law, PLC

(57) ABSTRACT

A modified A-frame tent or tarp shelter in which the fly or outer canopy is supported by two upright poles spaced apart on either side of a rectangular footprint. The poles are oppositely offset from the midpoint of the footprint on their respective sides, such that the canopy ridgeline between the poles crosses the footprint diagonally. Two corners of the canopy corresponding to corners of the footprint farthest from their respective (same-side) poles are raised and tensioned by short struts that, in cooperation with the offset poles, create a sidewall effect across the ends of the canopy over the head and foot ends of the footprint. The canopy may further include vestibule portions extending to the sides of the footprint, and the struts may also engage the vestibule portions at their respective corners.

12 Claims, 10 Drawing Sheets

MODIFIED A-FRAME TENT SHELTER

RELATED APPLICATIONS/PRIORITY BENEFIT CLAIM

This application claims the benefit of U.S. Provisional Application No. 61/513,827, filed Aug. 1, 2011 by the same inventor (Shires), the entirety of which provisional application is incorporated herein by reference.

FIELD

The subject matter of the present application is in the field of portable tent and tarp shelters for hikers, backpackers, and campers.

BACKGROUND

Modified versions of the classic A-frame tent or tarp shelter are known, and include both floored and floorless styles. Modern shelters of this type commonly use a weatherproof nylon or polyester fabric "fly" (canopy) supported by two spaced upright poles, for example adjustable length hiking or "trekking" poles. The main body of the canopy defines a lengthwise, generally rectangular main floor plan or "footprint" between the poles, under which hikers can shelter and sleep, with semi-pyramidal vestibule end portions of the canopy staked down outwardly of the poles. One or both of the vestibule ends usually includes a door. The canopy may be used alone as a floorless shelter, or in combination with an attached floor or inner tent made from varying fabrics.

Two poles erected at the peak ends of the canopy ridgeline support the ridgeline, while ground-level edges of the canopy are secured to the ground directly or through guy lines, using stakes or other fixed supports. The walls of the canopy generally slope directly toward the ground from the ridgeline and peaks, without vertical wall portions, and thus limit the interior useable space. Increasing the pole height and canopy slope angle for a given footprint increases useable space relative to the footprint, but can reduce the shelter's stability in wind and increase its weight. Generally available trekking poles limit practical maximum height to 145 cm/57 in or lower, absent separate trekking pole tip extenders.

As a practical matter, useable space is space where the canopy walls are high enough above the ground so that the occupants and their gear are not pressing against or distorting the canopy walls while inside. Although preferences will vary, I prefer to define useable space as the interior volume where all canopy fabric is 12" (inches) or more above the ground. This allows room for feet and heads to be clear of the canopy fabric while sleeping.

BRIEF SUMMARY

I have invented a modified A-frame tent shelter, comprising a fabric canopy with a main canopy defining or overlying a generally rectangular footprint or floor with longer sides and shorter ends. The main canopy includes two peaks adapted to be supported above the ground/footprint by two upright poles, adjacent the sides of the main canopy and spaced from the ends of the main canopy. The peaks are spaced in opposite directions from the midpoints of their respective sides of the main canopy, defining a canopy ridgeline that crosses the main canopy (and the footprint) diagonally from one side to the other side. Two lower corners of the canopy farthest from their respective (same-side) peaks, and generally orthogonal to the ridgeline, are adapted to be raised and tensioned on short struts that create a sidewall effect across the ends of the main canopy over the head and foot ends of the main canopy when the canopy is erected.

The main canopy includes tensioning points at the corners adapted to tension and secure the canopy against the upright poles and struts with guy lines and/or stakes or other anchors secured to the ground.

The main canopy is essentially coextensive with the rectangular footprint, meaning that it covers an essentially rectangular area corresponding to the footprint when erected at its peaks on poles and at its orthogonal-to-the-ridgeline corners on struts. The erected main canopy also defines two quadrilateral side openings to the footprint area, in the shape of a trapezoid (two parallel edges) or trapezium (no parallel edges) depending on the angle at which the corner struts are tensioned.

In a further form, the canopy includes fabric vestibule portions extending from the sides of the main canopy beyond the footprint. The vestibule portions may slope from the main canopy to ground level, where they can be secured with stakes or equivalent.

In a further form, the main canopy and vestibule portions comprise substantially triangular panels of fabric defining a faceted hexagonal configuration sloping to the ground from the peak ends and ridgeline. The triangular fabric panels may be defined by actual seams, a bias cut in the fabric, and/or the natural tension lines in the fabric when the canopy is erected on poles and struts and secured to the ground.

In further form, doors are provided in one or both vestibule portions of the canopy.

The footprint may be the covered area under the main canopy, or a fabric floor located under the main canopy, for example as part of an inner tent attached to or supported under the canopy. "Footprint" can accordingly include a virtual floor defined by the ground area covered by the main canopy when erected, or an actual floor made from fabric.

These and other features and advantages of the invention will become apparent from the detailed description below, in light of the accompanying drawings.

DETAILED DESCRIPTION

Figure 1:
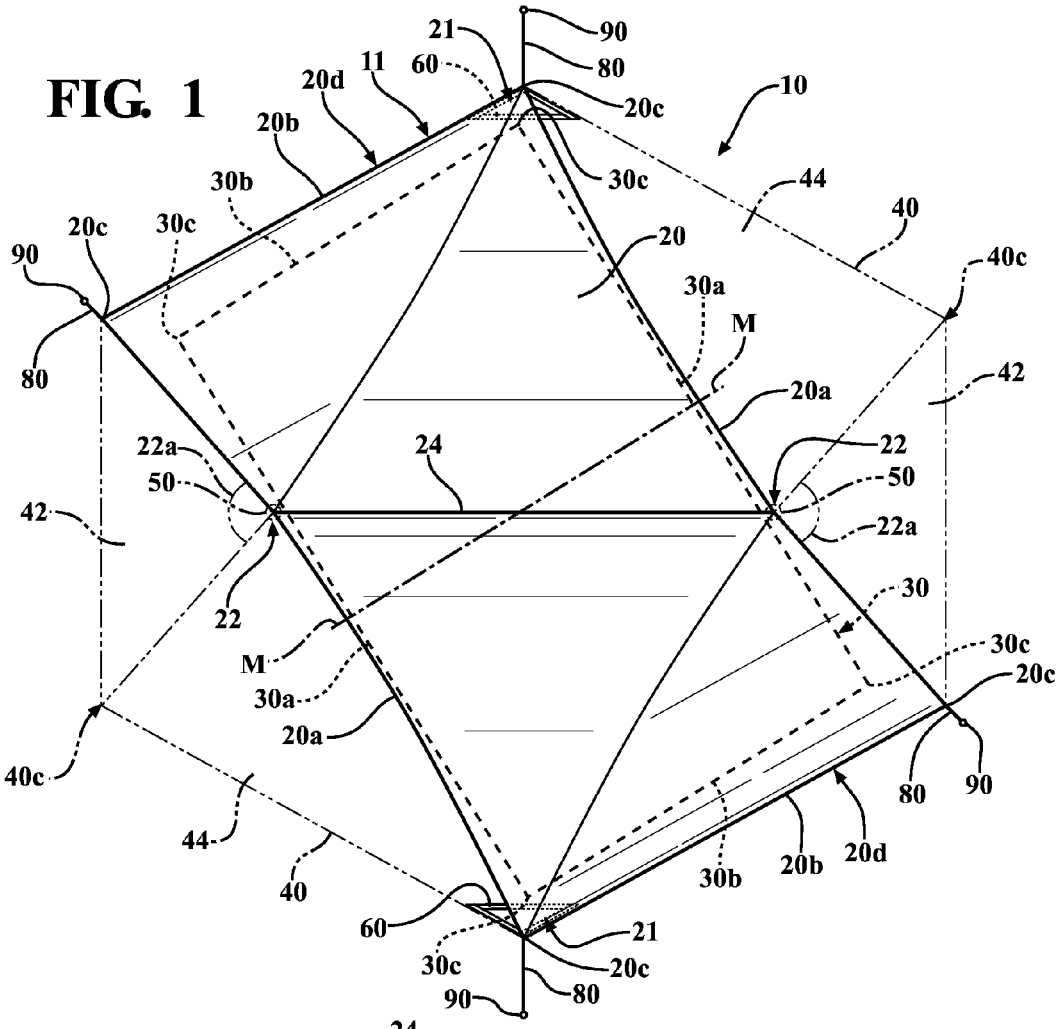
FIG. 1 is a top plan view of a shelter according to the invention, with vestibule portions of the fly shown in phantom lines and a rectangular footprint under the main canopy shown in hidden lines.
Figure 2:
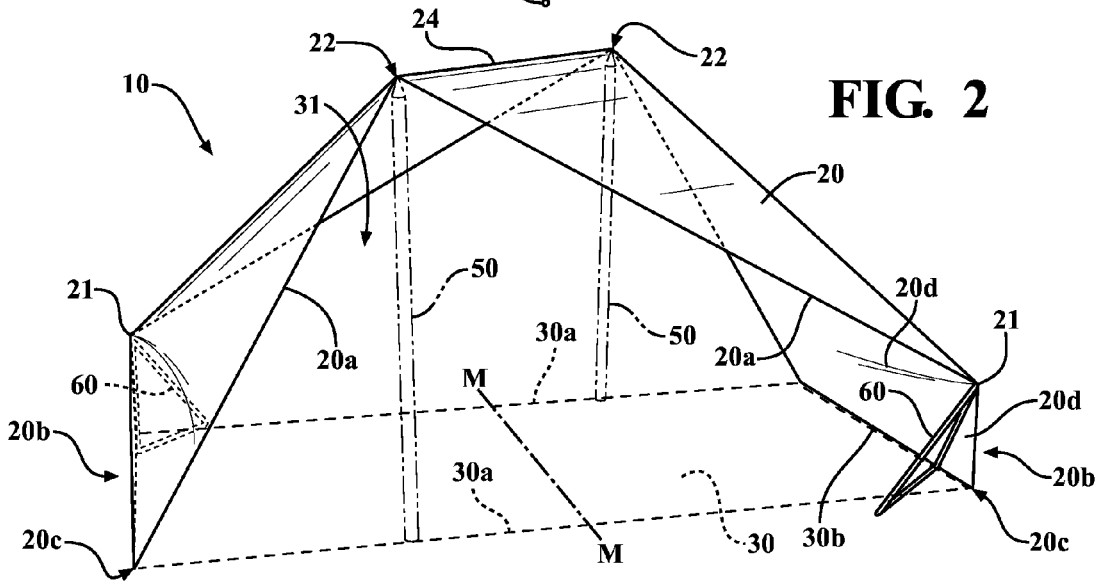
FIG. 2 is a side perspective view of the main canopy and footprint portions of the shelter of FIG. 1.

Referring first to FIGS. 1 and 2, a shelter 10 is shown in exemplary form in order to teach how to make and use the claimed invention. Shelter 10 includes a weatherproof canopy 11 having a main canopy portion 20 overlying and/or defining a rectangular footprint 30, and one or more vestibule portions 40 extending outwardly of each long side 30*a* of footprint 30. Main canopy 20 could be used without vestibules 40, and so the vestibules are shown in broken lines, but the vestibules are preferred.

Main canopy 20 has longer sides 20*a*, and shorter ends 20*b*. Footprint 30 has longer sides 30*a* and shorter ends 30*b*. The sides and ends of main canopy 20 correspond approximately to the sides and ends of footprint 30, meaning that when shelter 10 is erected with the main canopy tensioned above the ground/footprint, the ground-level (straight-line) distance between corners 20*c* along the sides 20*a* of the canopy is equal to or greater than the distance between corners 30*c* along the sides 30*a* of the footprint, and the ground-level distance between corners 20*c* along the ends 20*b* of the canopy is equal to or greater than the distance between corners 30*c* along the ends 30*b* of the canopy. The result is that the rectangular area defined under main canopy 20 in its erected configuration is equal to or greater than the rectangular area of footprint 30.

It will be understood that when relative fabric dimensions and shapes are discussed herein, reasonable variations should be taken into account. Such known variations include approximations as to the non-rigid shape of structures formed largely from fabric; fabric tolerances; fabric finishing details (tie-out points, catenary cuts, rounded edges, bathtub floors); fabric tension variations under different weather conditions; deformation of the shelter from the ideal shape when set up on irregular terrain; and variations in set up and tensioning by people of different skill levels. Terms of shape, size, and orientation such as rectangular, orthogonal, upright, triangular, equal length and similar should be given reasonable interpretation due to such factors.

Main canopy 20 includes two peaks 22 adapted to receive the ends of upright support poles, for example adjustable-length hiking or "trekking" poles 50. For this purpose peaks 22 may be shaped and reinforced with heavier or different fabric or other material, or may include pole-receiving structure such as grommets or cups. Peaks 22 are joined by a ridgeline 24, which may be a straight- or catenary-cut seam, or a bias line in the canopy fabric when the shelter is erected. Peaks 22 may be provided with vents 22*a*.

The peaks of an A-frame type shelter can also be supported by suspending them in tension from an overhead support, such as a tree branch or poles braced in a V-shape over the peak. This is usually accomplished by running lines from grommets (not shown, but known) on the exterior of the peaks to the overhead support. Shelter 10 could also be supported in this fashion, and this manner of support should be included in the definition of pole-supported.

The peaks 22 are spaced in opposite directions from the midpoints M of their respective sides 20*a* and 30*a* of the main canopy and footprint (the midpoint of the main canopy as a whole), defining a canopy ridgeline 24 that crosses the footprint 30 diagonally (at an acute angle rather than orthogonally) from one side 30*a* to the other side 30*a*. Peaks 22 are also spaced from the nearer or non-strut corners 20*c*, 30*c* on their respective sides of the main canopy. Peaks 22 and any upright poles 50 supporting them are adjacent the sides 20*a* of the canopy and 30*a* of the footprint, lying either within, on, or outside of the actual side edges of the canopy and footprint depending on their relative dimensions and the desired placement of the pole bottom ends.

To give an idea of scale, a typical peak height for a shelter 10 designed to accommodate two sleeping people in footprint 30 would be in the range of forty to fifty inches or so off the ground, using a typical pair of adjustable trekking poles 50 for support. The dimensions of shelter 10 can vary depending on the number of occupants for which footprint 30 is sized, and the desired ratios between interior room, height, weight and weather-worthiness (the latter dependent in part on the angle and tension of the canopy walls). These and other factors will be understood by those skilled in the art of portable tent and tarp shelters.

The canopy of illustrated shelter 10 includes optional but preferred fabric vestibules 40 that extend weather protection beyond main canopy 20 and footprint 30. Vestibules in tent shelters are commonly floorless, providing dry storage and increased ventilation when the canopy is closed down for weather protection. Vestibules 40 may be permanently attached to the main canopy, as by sewing or as fabric extensions thereof, or may be detachable from the main canopy. Illustrated vestibules 40 include first smaller panels 42 and second larger panels 44, at least one of which is at least partially separable from an adjacent panel or adjacent edge of the main canopy 20 to function as a door flap. In the illustrated example, all panels 42 and 44 can be separated sufficiently from each other and/or from the main canopy to roll or zip them aside to provide doors on each side of shelter 10.

A further feature of illustrated vestibules 40 is the use of faceted triangular panels for 42 and 44, resulting in semi-pyramidal vestibule volumes and an overall hexagonal shape (in plan view) for shelter 10 when vestibules 40 are staked in place. In the illustrated example, smaller first panels 42 are isosceles triangles (preferred for stable, symmetrical tensioning of peaks 22 and ridgeline 24), and larger second panels 44 are scalene triangles.

Shelter 10 is erected by securing at least the four corners 20*c* of the main canopy 20 to the ground, for example with stakes and/or guy lines 80 and 90, and by inserting upright poles 50 into peaks 22. The corners of canopy 20 are provided with tie-out points of known type, which may include grommets, tabs, loops, pre-installed guy lines, or other known options for securing the corners to the ground.

If the main canopy 20 is not provided with vestibules such as 40, or if vestibules 40 are rolled up or removed, then the staked corners 20*c* should be supplemented with guy lines 82 (FIGS. 7 and 7A) extending from peaks 22 and anchored to tension the pole-supported canopy orthogonally to the sides, for example by securing the lines to the ground with stakes. If the main canopy 20 is supplemented with vestibules 40, then the vestibules can be staked at their corners 40*c* to tension the poles orthogonally to their respective footprint sides 30*a*.

Still referring to FIGS. 1 and 2, the two main canopy corners 20*c* located generally orthogonally to the ridgeline 24 (or farthest from their respective peaks/poles) are adapted at 21 to be supported above the ground by substantially stiff struts 60. This has been found to significantly increase useable interior space by creating a generally vertical sidewall 20*d* at corners 21 and across at least a portion of the canopy ends 20*b*, without compromising stability or adding significant weight, as best shown in FIG. 2. "Orthogonal" should be understood as meaning the general direction in which the strut-supported corners 21 tension the ridgeline through the canopy fabric.

The sidewall 20*d* created across canopy end 20*b* by the strut at corner 21 has the form of a mildly twisted plane or curved panel, highest and most vertical at strut corner 21 and gradually returning toward the natural slope of canopy 20 at the other (same-side, non-strut) corner 20*c*. In this sense, sidewall 20*d* can be considered a virtual sidewall, or a sidewall effect, since it need not (although it could) be formed in the canopy fabric as a separate panel, and since its geometry gradually changes across canopy end 20*b* from strut corner 21 to non-strut corner 20*c*.

The curvature and gradual reduction of the sidewall effect 20*d* across canopy end 20*b* is mitigated by the offset of peaks 22 and poles 50 from the midpoints of the shelter. This pole offset toward the non-strut corners 20*c* creates a steeper slope angle for the fabric in non-strut corners 20*c*, helping to maintain the verticality and height of the sidewall 20*d* created by strut 60 at the other corner.

Where shelter 10 includes a vestibule 40 as part of the overall canopy, the strut structure may be used to create and/or tension a similar generally vertical sidewall 44*d* in vestibule panel 44 adjacent corner 21, with similar results along the lower edge of panel 44.

The height at which strut-supported corners 21 are supported above the ground can vary, but in the illustrated example a height of 13" (inches) has been found useful to provide a vertical sidewall 20*d* along at least a portion of the ends 20*b* of main canopy 20. In general the height at which strut-supported corners 21 are supported above the ground should be at or above the minimum useable interior height determined for that shelter.

The structure of struts 60 may vary, and can be as simple as single straight pieces of substantially stiff material such as aluminum tent pole tubing and other known equivalents. In the illustrated example, struts 60 and the strut-supported corners 21 are the inverted V-shaped struts and fabric corner structure described in my U.S. Pat. No. 7,841,356 issued Nov. 30, 2010, the entirety of whose disclosure is hereby incorporated by reference.

Referring now to FIGS. 2, 3, 3A, and 4, illustrated strut structure 60 includes two strut legs 62, each leg 62 being integrated into a respective portion of the fabric forming corner 21, namely one leg 62 integrated with main canopy end 20*b* and the other leg 62 integrated with vestibule panel 44 near the intersection of the main canopy 20 and the vestibule panel 44. The lower ends of the strut legs 62 are spaced apart, but connected by a strap 66, and rest on the ground. Although not connected to each other, the upper ends of the strut legs 62 converge toward the upper end of corner 21, forming a triangular or inverted V-shape. In the illustrated embodiment, the strut legs 62 are secured in fabric sleeves 64 sewn to the inner faces of the canopy fabric. In the illustrated embodiment the lower ends of the sleeve/strut combination extend below the lower edges of the canopy fabric to keep the lower edges of the canopy raised a few inches off the ground. It will be understood, however, that varying schools of thought exist as to the best height for the lower edges of the canopy relative to the ground, often depending on the weather conditions for which the shelter is designed, and so the lower ends of the struts 62 and sleeves 64 could also be even with the lower edges of the canopy fabric for a flush fit to the ground, or in the case of a shelter whose lower fabric edges are intended to be buried as sand/snow flaps could even terminate above the lower fabric edges of the canopy.

Strut legs 62 can be made from any known material commonly used for tent poles and struts, for example short lengths of aluminum tubing, carbon-fiber rods, fiberglass rods, stiff plastic rods, etc. It will also be understood that while a cylindrical tube or rod shape is preferred, non-cylindrical or non-tubular shapes such as flat slats or battens can be used. The important thing is that the struts 62 be relatively rigid and stiff enough to provide support and tension to the fabric walls formed in the canopy at corner 21. The lower ends of the struts 62 are connected by a flexible strap such as 66 to positively limit the distance they can be spread apart in tension by the canopy fabric when the shelter is staked out. By forming the struts 60 as separate legs 62 joined only by a flexible strap 66, they can be collapsed and rolled up with the shelter 10. Therefore this is the preferred, but not the only, way to form the strut structures 60. For example, the strut structure 60 could use a rigid, removable connector leg instead of a strap to join the lower ends of strut legs 62 when the tent shelter is erected. Alternately, the struts 60 may be integrated with the canopy fabric in a manner making them easily removed when taking the shelter down.

Figure 4:
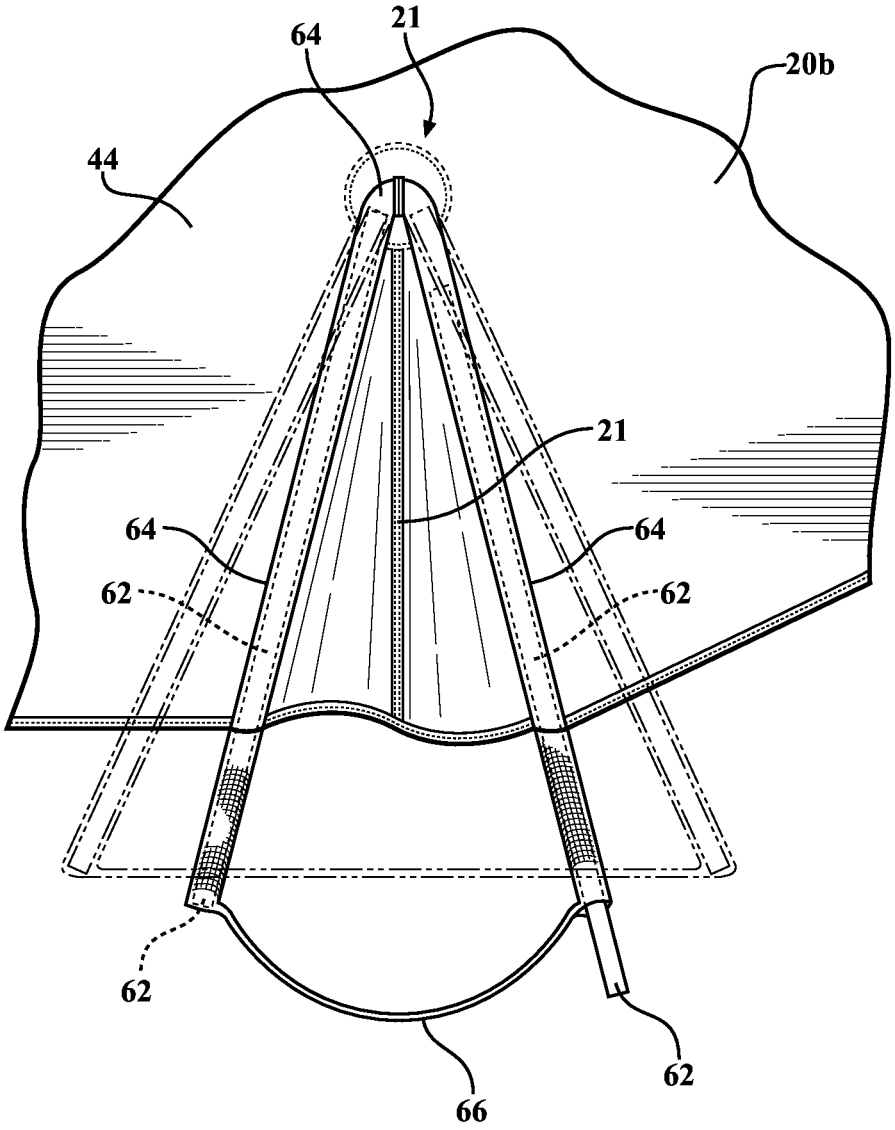
FIG. 4 is a view of the inside fabric of a corner of the tent in FIG. 1, showing a sleeve structure for attaching the strut legs to the corners, with one of the strut legs shown partially inserted in its sleeve.

FIG. 4 is a direct view of the inside faces of main canopy end 20*b* and vestibule panel 44 where they intersect at corner 21, and of the sleeve-enclosed strut legs 62 where they are sewn to the fabric. FIG. 4 also shows one of the strut legs 62 partially inserted in its sleeve 64. Illustrated sleeve 64 is made from lightweight nylon webbing folded lengthwise and sewn into a tube with two end openings for the struts, and then sewn into the canopy fabric corresponding to 20*b* and 44. The strut legs 62 are then inserted in the sleeve 64 to form the strut structure 60. In a preferred form, the length of sleeve 64 is longer than the combined length of the inserted strut legs 62, such that the unfilled ends of the sleeve can be removably or permanently connected to form the connecting-strap 66. The manner of construction of sleeve 64 and connecting-strap 66 can vary, however, and they do not have to be formed separately from the canopy and subsequently attached, and they do not have to be an integral piece of material. For example, connecting strap 66 could be a detachable piece of cord, or a detachable or permanent connector of a more rigid nature than a cord or strap; sleeve 64 could be two separate sleeves of tent body material in their respective corner-forming walls, or sleeve equivalents (such as clips) capable of connecting the struts 62 to the fabric walls.

It will be understood that while it is highly preferred that the lower ends of struts 62 are connected as shown to positively limit their spread, it is also possible to leave them unconnected, provided that the lower ends of the struts 62 are secured in place in their spread apart position. For example, the lower ends of strut legs 62 could be secured to a tent floor using grommets, or could be staked into the ground, or could be jammed into the ground or snow.

Strut legs 62 can be sealed permanently in sleeve(s) 64 by sewing or other means, or the ends of sleeve(s) 64 could be left open, or provided with a removable cover or flap, so that strut legs 62 can be removed and replaced as needed.

Still referring to FIG. 4, the separate, independently movable connection of the strut legs 62 to their respective fabric walls allows the legs to be folded or rolled up or stuffed with the canopy fabric without having to remove them from the canopy. When the canopy is set up in tension (phantom lines), the strut legs 62 tend to function as a single strut structure acting on the fabric at corner 21 because they are pulled apart evenly in tension by the canopy fabric walls 20*d* and 44*d*. When that tension is released (solid lines), the rigidity of the strut structure 60 is lost and the struts are free to move independently, constrained only by their connection to their respective walls of the canopy fabric via sleeve(s) 64.

Figure 3:
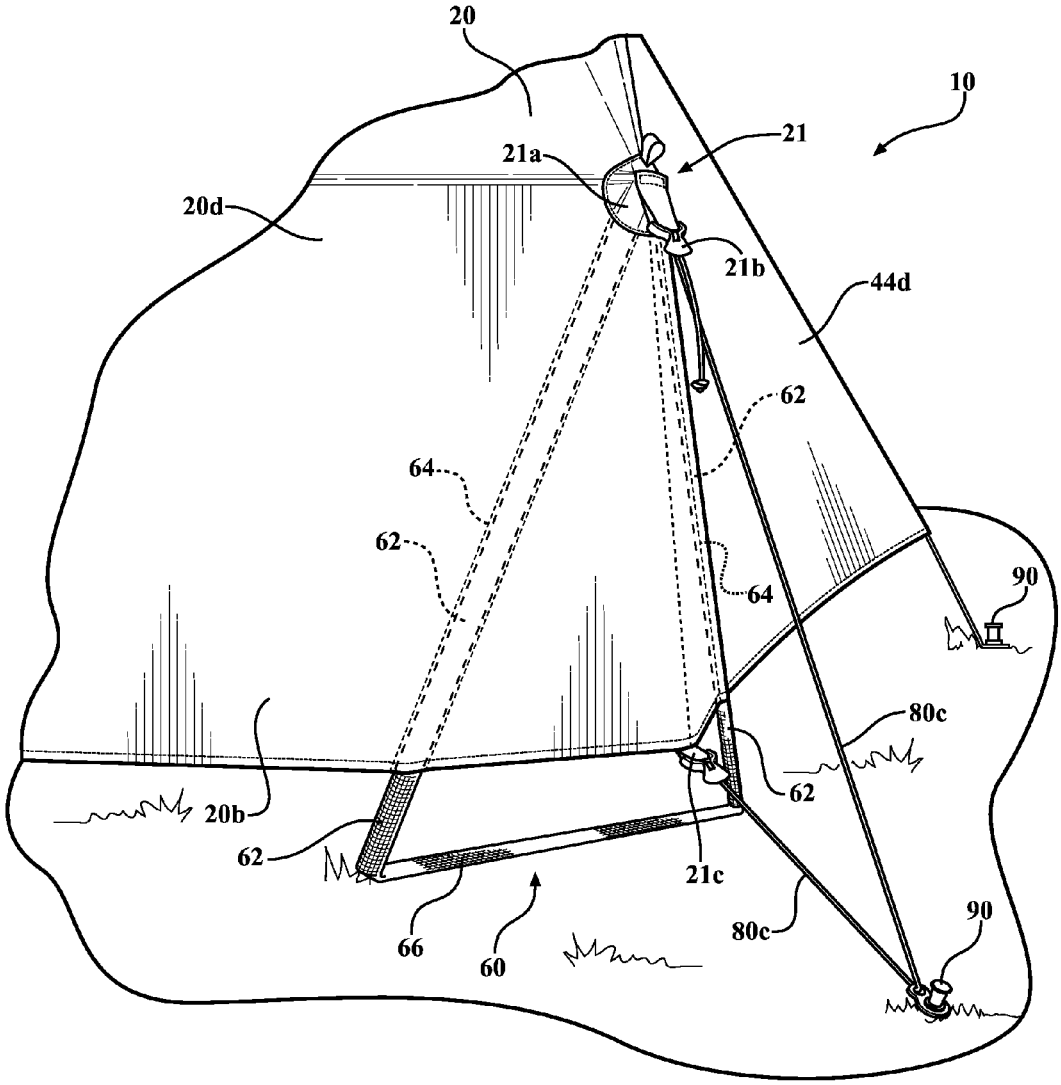
FIG. 3 is a detail perspective view of a strut-supported corner of the canopy.
Figure 3A:
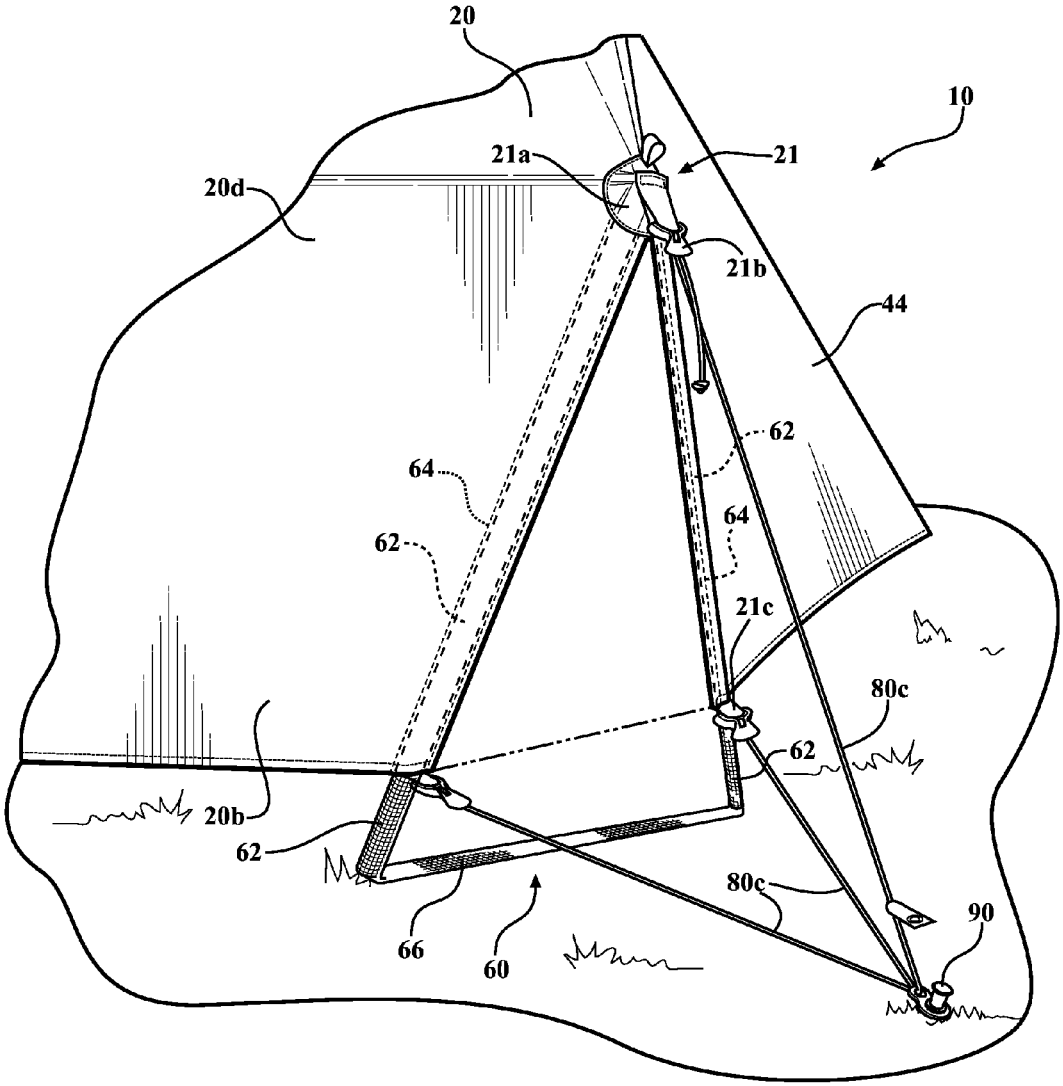
FIG. 3A is similar to FIG. 3, but shows an alternate corner structure for the tent fabric.

Referring again to FIG. 3, shelter 10 is set up in tension and the strut structure 60 is supporting and tensioning the corner 21 in conjunction with guyline 80*c* secured to the upper and lower ends of corner 21 and staked into the ground at 90. "Corner" at 21 refers to the substantially vertical junction of the end and side walls 20*d* and 44*d* when supported by strut 60, and not just the upper and lower ends or corners of the junction. But the substantially vertical corner need not be limited to a true or full intersection of adjacent walls for struts 60 to function. For example, as shown in FIG. 3A, the fabric walls 20*d* and 44*d* could end at their respective strut legs 62, with an triangular open space or a flat triangular panel of fabric (shown in phantom lines) between the strut legs, although in such cases it would be highly desirable to tension a lower portion of each strut leg 62 with cording (illustrated as additional guy lines 80*c*), straps, or stakes, or with connections to a tent floor, in order to maintain the V structure and prevent if from folding inward or pinching together. So while a full corner defining a vertical line or seam with upper and lower guyline attachment points as illustrated in FIG. 3 is preferred, other intersecting wall arrangements are possible.

The upper end of corner 21 is reinforced with a patch of strong fabric 21*a*, such as vinyl or heavy nylon, to better secure the upper pullout loop 21*b* to the relatively thin fabric of the tent body, and to provide a reinforced sewing attachment point for the upper end of strut sleeve 64. The lower pullout loop 21*c* can be sewn or otherwise fastened directly into the tent body material, or provided with its own reinforcement patch (not shown). While guyline 80*c* is shown as a double-ended line secured in the middle by stake 90 and tied or clipped at each end to the upper and lower ends of corner 21, it will be understood that a single guyline with a single attachment point to the upper end of corner 21 could be used (with the bottom end of the corner secured in some other fashion, for example by staking directly to the ground), or that multiple guylines with multiple attachment points could be used, although the illustrated two-point corner attachment with a single guyline connected to upper and lower portions of the corner is preferred.

Upper and lower pullout loops 21*b* and 21*c* are preferably provided with guy line tighteners of known type, to independently tension and adjust the upper and lower portions of fabric corner 21 through guy line 80*c*. As shown in the Figures, the optimal adjustment results in the upper end of V strut 60 being angled outwardly, while the fabric corner 21 remains more vertical due to the tension exerted by the guy line 80*c* on the lower portion of the corner through lower pullout loop 21*c*. Both the strut 60 and the fabric corner 21 can be considered substantially vertical, for example being generally less than forty-five degrees from vertical.

It will be understood that while the strongest fabric-supporting and tensioning structure is achieved when the lower ends of strut legs 62 are spread to their maximum as shown in the Figures, it is possible to adjust the spacing of their lower ends for different effects on the height and tension of the canopy fabric.

In a shelter 10 with canopy vestibule portions 40, a first leg of strut 60 is secured to a portion of panel 44 adjacent corner 21, and the second leg of strut 60 is secured to a portion of canopy end 20*a* adjacent corner 21. In a shelter 10 without vestibule portions 40, the first leg of strut 60 may be omitted, moved to a vertical connection with the vertical portion of corner 21, or secured or connected to the adjacent side edge 20*a* of main canopy 20; or, a different style of strut could be used, including a short straight upright strut.

Figure 5:
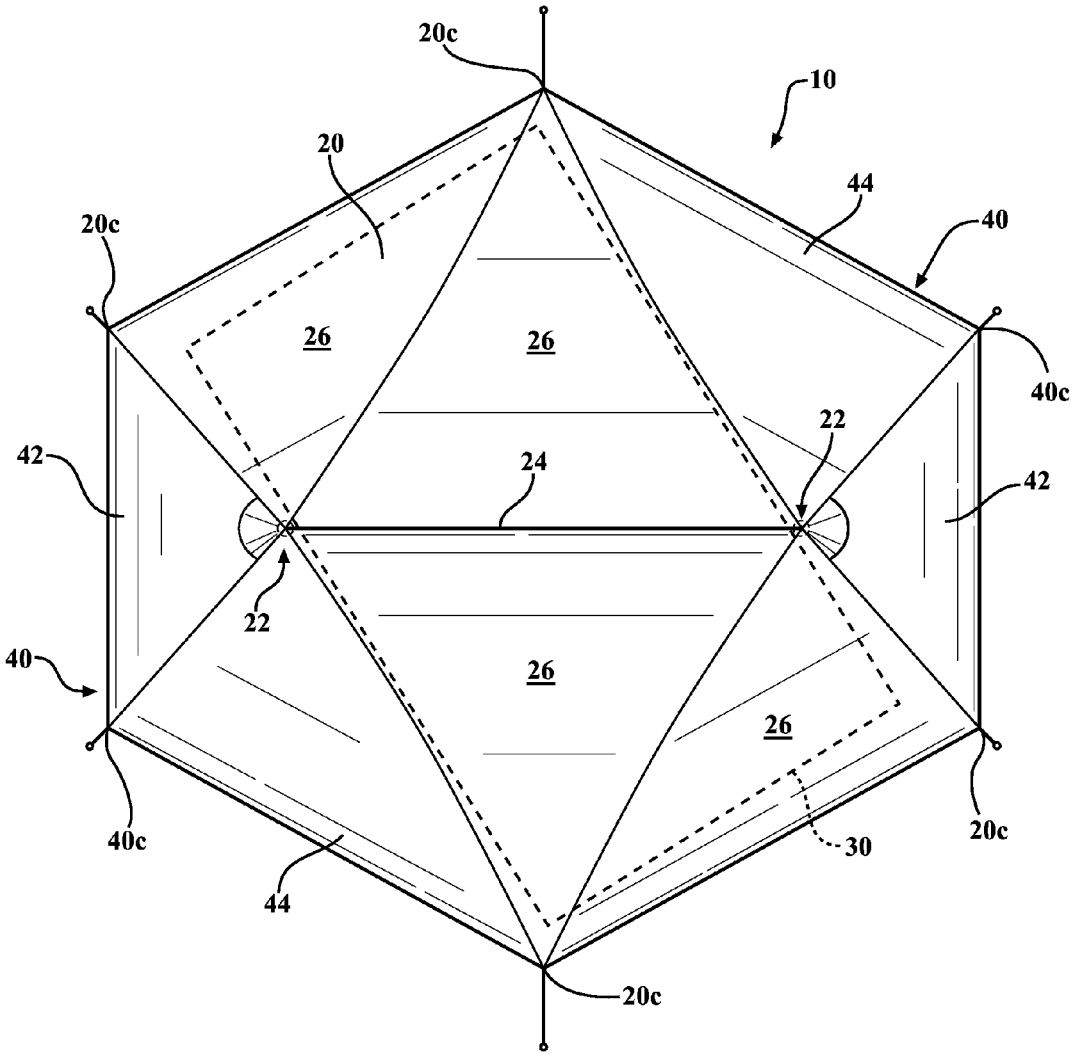
FIG. 5 is a top plan view similar to FIG. 1, but with the vestibule portions shown in solid lines.
Figure 6:
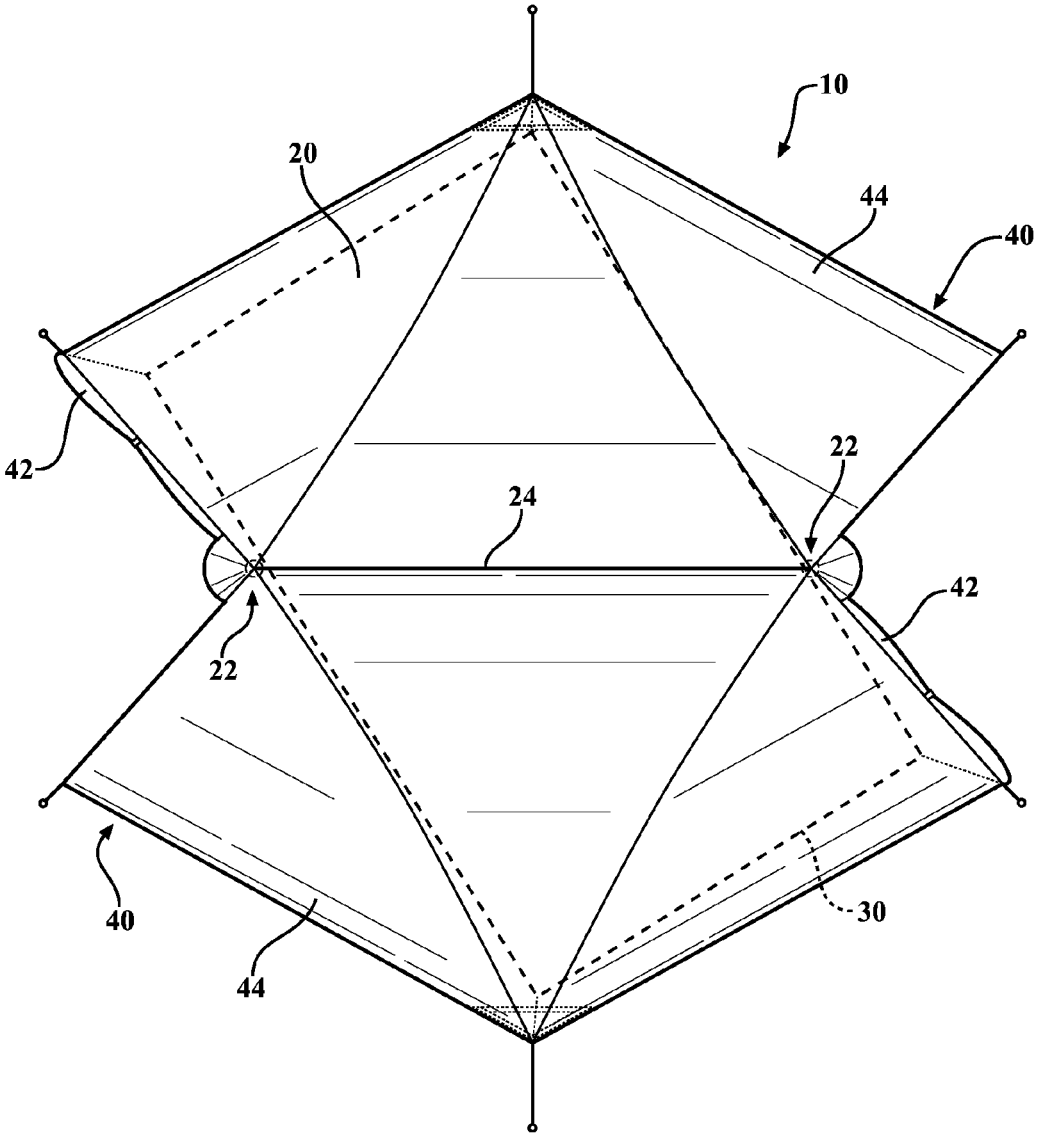
FIG. 6 is a top plan view similar to FIG. 5, with a first portion (flap) of each vestibule open to provide doors.
Figure 6A:
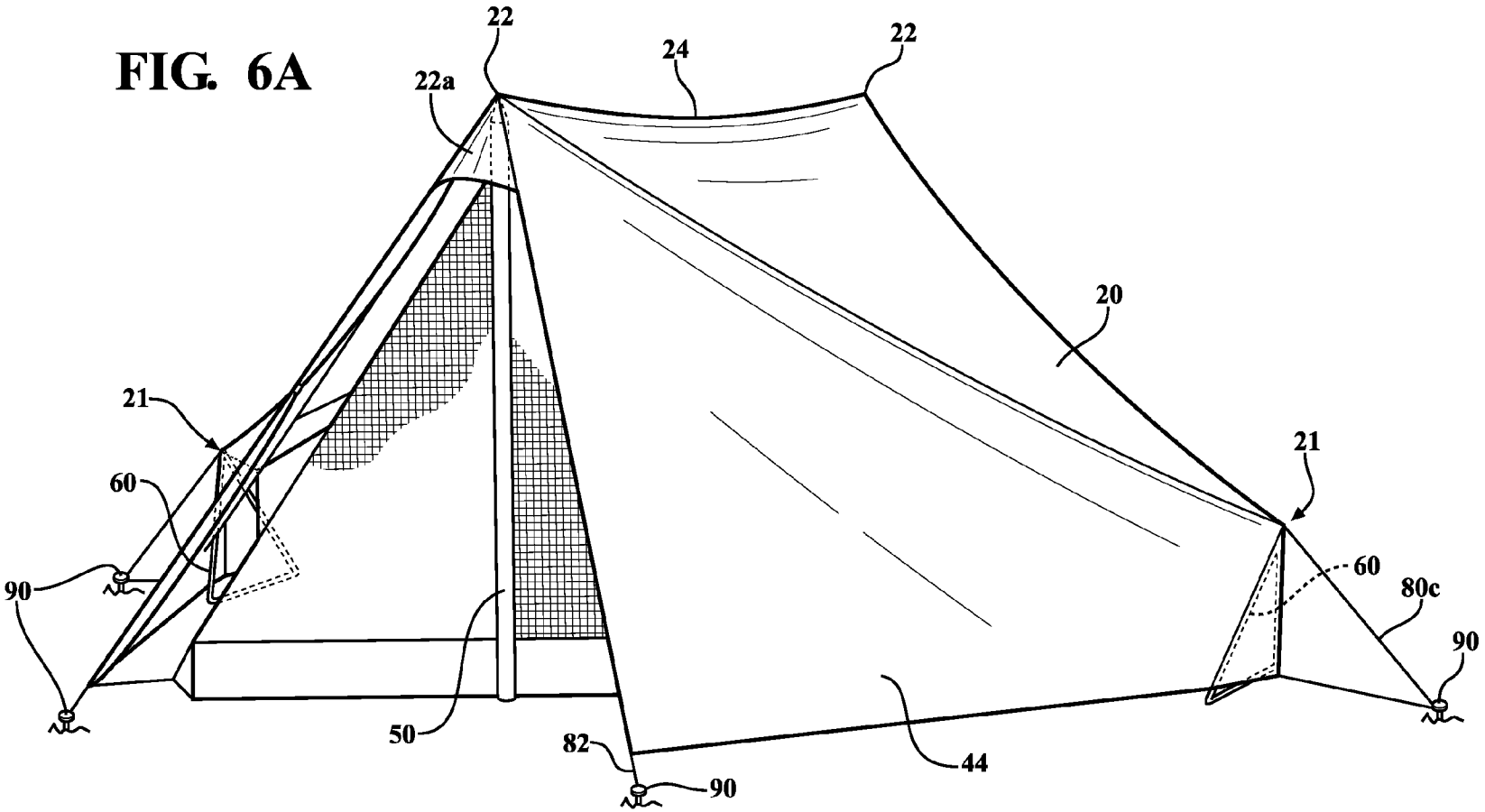
FIG. 6A is a side perspective view of the shelter in the condition of FIG. 6, with one door flap open.
Figure 7:
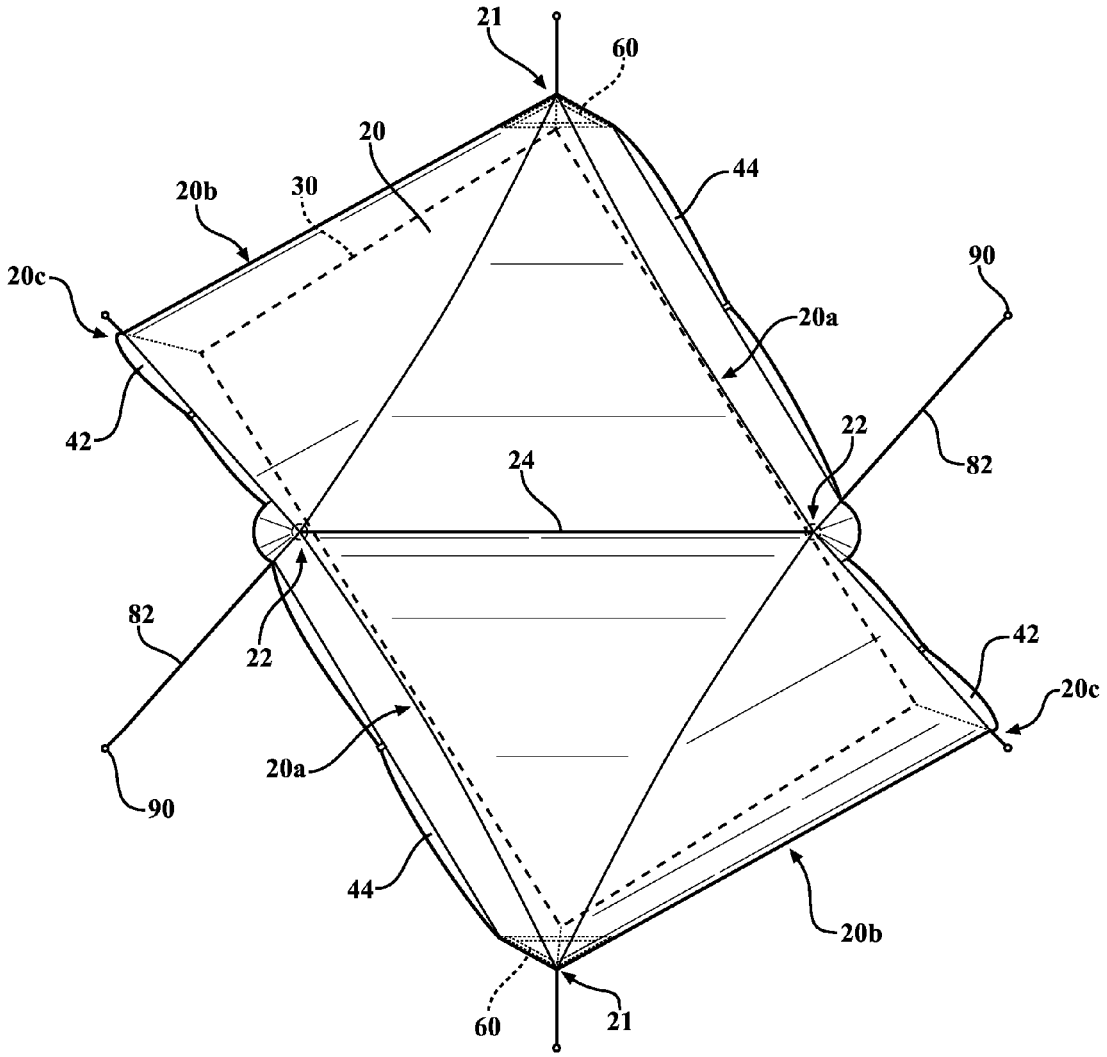
FIG. 7 is a top plan view similar to FIG. 5, with first and second flaps of each vestibule open to provide unobstructed access to the footprint area under the main canopy.
Figure 7A:
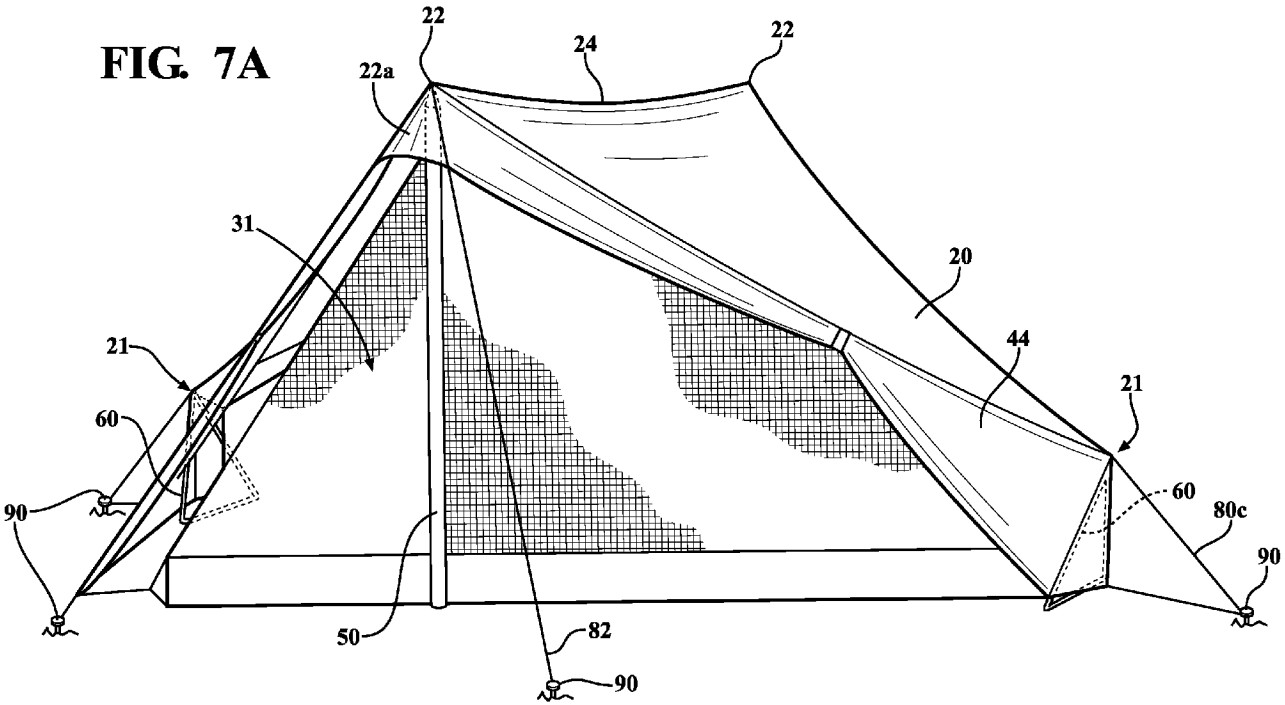
FIG. 7A is a side perspective view of the shelter in the condition of FIG. 7, with both door flaps open.
Figure 8:
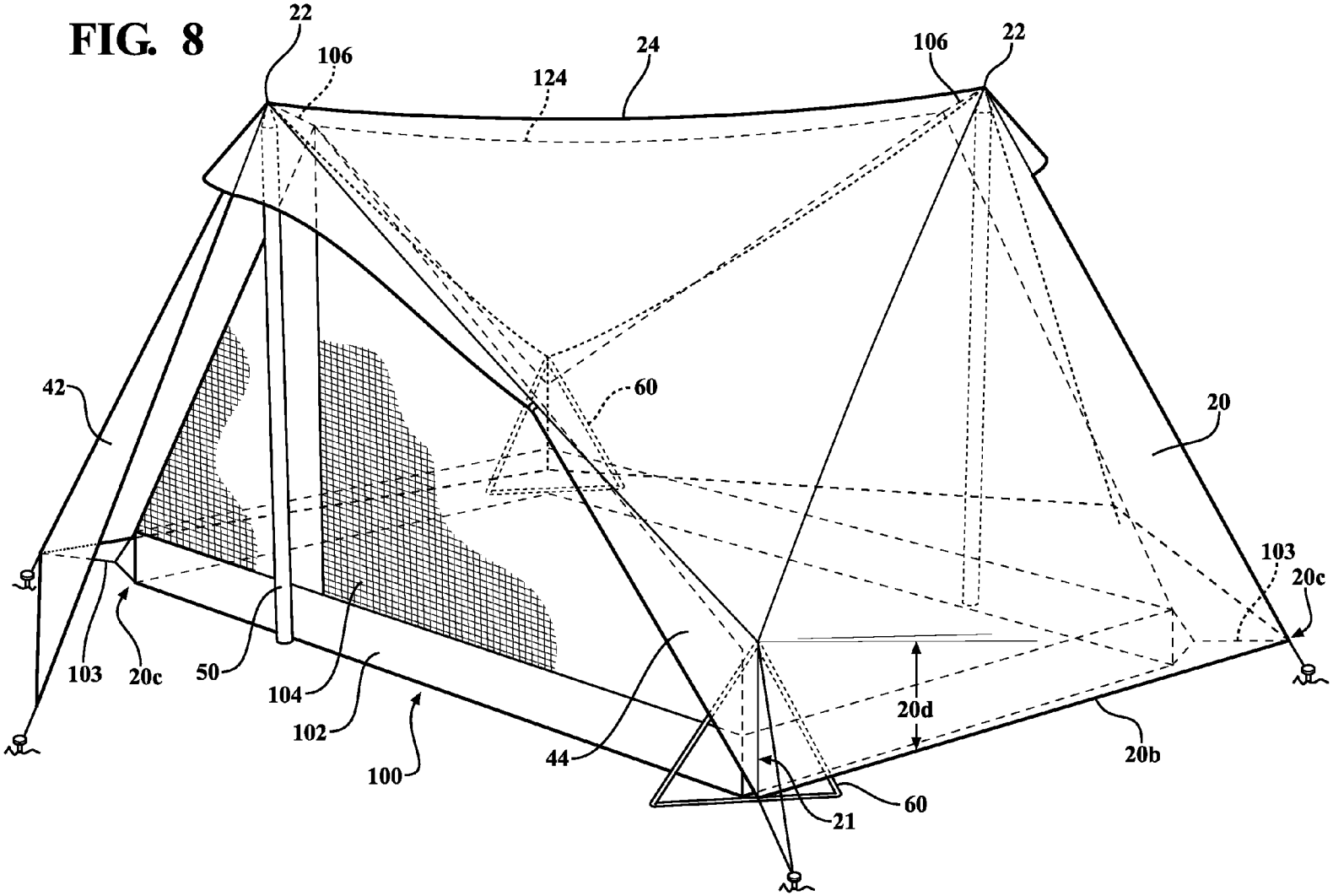
FIG. 8 is a corner perspective view of the shelter of FIG. 1, with an inner tent shown in hidden lines under the canopy.

Referring to FIGS. 5 through 8, shelter 10 is shown with the doors of vestibule portions 40 in closed, partially open, and fully open positions. FIG. 5 shows shelter 10 with both vestibules 40 fully closed and staked to the ground at corners 40*c* for full weather protection. FIGS. 6 and 6A shows door flaps 42 open on both sides of the shelter, for partial weather protection. FIGS. 7 and 7A show door flaps 42 and 44 open on both sides of the shelter, for the most ventilation and least weather protection. FIG. 7A best reveals the quadrilateral side opening 31 under the main canopy 20, created in part by the strut support 60 at corner 21. FIG. 8 shows the larger door flap 44 open, and the smaller flap 42 staked down.

FIGS. 6A, 7A and 8 also show an optional inner tent 100 under the main canopy, with a substantially rectangular "bathtub" style floor 102 corresponding in size and shape to the main canopy 20, and insect netting walls and doors 104. Inner tent 100 may be supported under main canopy 20 in any manner, including but not limited to being detachably suspended from hooks or clips or the tips of poles 50 on the inside of canopy 20; having mating peaks (not shown) matching the peaks 22 in the outer canopy, with poles 50 inserted into peaks 22 from inside inner tent 100; and being sewn or otherwise permanently attached to the underside of canopy 20. In the illustrated example, inner tent 100 is detachably suspended by cords 106 from the upper ends of poles 50 at peaks 22 inside canopy 20, and the floor corners 102*c* of the inner tent are tensioned with elastic cords 103 detachably connected to the corners 20*c* of the main canopy.

It will be noted in all Figures above that the shelter canopy 11 (comprising main canopy 20 and vestibules 40) is composed of triangular panels in a faceted hexagonal configuration having six main stakeout points. Main canopy 20 is composed of four triangular faceted panels 26 (see FIG. 5 for reference numerals). Vestibules 40 are composed of triangular panels 42 and 44. None of the adjacent panels is coplanar, resulting in reduced wind-load on the fabric structure of the shelter from any angle. As noted above, the panels may be sewn together at their junctions, or formed by biases in the cut of the canopy fabric and/or the tension in the canopy when erected on poles and struts.

It will be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports, whether the claims are made in this provisional application or in a non-provisional application claiming priority to this provisional application.

What is claimed:

1. A portable tent type fabric shelter comprising:

a main canopy capable of an erected configuration defining a generally rectangular plan with longer sides and shorter ends and defining a generally rectangular footprint having longer sides and shorter ends, the main canopy comprising two peaks adapted to be pole-supported above the ground and four end corners adapted to be secured to the ground in tension against the pole-supported peaks in the erected configuration, one of the peaks located adjacent one side of the main canopy and the other of the peaks located adjacent the other side of the main canopy, the peaks spaced from the ends of the main canopy and offset in opposite directions along their respective sides from a side-to-side midpoint of the main canopy, the peaks defining a ridgeline extending between them that crosses the midpoint diagonally from one side to the other side of the main canopy, wherein two of the end corners of the main canopy farthest from their respective sides' peaks and generally orthogonal to the ridgeline comprise short struts adapted to raise and tension the two corners and create a vertical sidewall effect in the ends of the main canopy in the erected configuration.

2. A shelter according to claim 1, wherein the main canopy includes a vestibule associated with each side of the main canopy.

3. A shelter according to claim 2, wherein the vestibules and main canopy define a hexagonal footprint in the erected configuration.

4. A shelter according to claim 3, wherein each of the vestibules comprises a smaller triangular panel and a larger triangular panel and includes an outer corner adapted to be secured to the ground in the erected configuration, and wherein the outer corner is offset from the midpoint of the canopy in the same direction as the nearest peak.

5. A shelter according to claim 1, wherein the footprint comprises a rectangular floor associated with the main canopy.

6. A shelter according to claim 1, wherein the other two of the four end corners of the main canopy are adapted to be tensioned to the ground essentially at ground level when in the erected configuration.

7. A portable tent type fabric shelter comprising:

a main canopy defining a generally rectangular plan with longer sides and shorter ends and defining a generally rectangular footprint having longer sides and shorter ends, the main canopy comprising two peaks pole-supported above the ground and four end corners secured to the ground in tension against the pole-supported peaks, one of the peaks located adjacent one side of the main canopy and the other of the peaks located adjacent the other side of the main canopy, the peaks spaced from the ends of the main canopy and offset in opposite directions along their respective sides from a side-to-side midpoint of the main canopy, the peaks defining a ridgeline extending between them that crosses the midpoint diagonally from one side to the other side of the main canopy, wherein two of the end corners of the main canopy farthest from their respective sides'peaks and generally orthogonal to the ridgeline comprise short struts adapted for raising and tensioning the two corners to form a vertical sidewall effect in the ends of the main canopy.

8. A shelter according to claim 7, wherein the main canopy includes a vestibule associated with each side of the main canopy.

9. A shelter according to claim 8, wherein the vestibules and main canopy define a hexagonal footprint.

10. A shelter according to claim 9, wherein each of the vestibules comprises a smaller triangular panel and a larger triangular panel and includes an outer corner secured to the ground, and wherein the outer corner is offset from the midpoint of the canopy in the same direction as the nearest peak.

11. A shelter according to claim 7, wherein the footprint comprises a rectangular floor associated with the main canopy.

12. A shelter according to claim 7, wherein the other two of the four end corners of the main canopy are tensioned to the ground essentially at ground level.

* * * * *